US005495877A

United States Patent [19]

Schwenk et al.

[11] Patent Number: 5,495,877

[45] Date of Patent: Mar. 5, 1996

[54] DEVICE, KIT, AND PROCESS FOR FILLING OF A PRINT CARTRIDGE OF AN INK JET PRINTER

[75] Inventors: Peter Schwenk, Schenkenzell; Christoph Henzler, Schramberg, both of Germany

[73] Assignee: PMS GmbH Production + Recycling von Bueromaschinenzubehoer, Eschbronn-Locherhof, Germany

[21] Appl. No.: 290,411

[22] Filed: Aug. 15, 1994

[30] Foreign Application Priority Data

Aug. 13, 1993 [DE] Germany ..... 43 27 178.2

[51] Int. Cl.[6] ..... B65B 1/04; B65B 3/00

[52] U.S. Cl. ..... 141/370; 141/330; 141/18; 141/372; 141/375; 141/383; 346/140.1

[58] Field of Search ..... 141/2, 18, 98, 141/330, 346, 363, 364, 369, 370, 372, 375, 378, 383, 386; 346/140.1; 222/325

[56] References Cited

U.S. PATENT DOCUMENTS

| | | | |
|---|---|---|---|
| 4,607,671 | 8/1986 | Aalto et al. | 141/383 |
| 4,872,494 | 10/1989 | Coccia | 141/383 |
| 4,967,207 | 10/1990 | Ruder | 346/140.1 |
| 5,247,972 | 9/1993 | Tetreault | 141/383 |
| 5,354,287 | 10/1994 | Wacks | 141/383 |

FOREIGN PATENT DOCUMENTS

| | | |
|---|---|---|
| 0568124 | 4/1993 | European Pat. Off. . |
| 3401071 | 7/1985 | Germany . |
| 9220577 | 11/1992 | WIPO . |

*Primary Examiner*—Henry J. Recla
*Assistant Examiner*—Steven O. Douglas
*Attorney, Agent, or Firm*—Dominik & Stein

[57] ABSTRACT

A device for refilling a print cartridge (100) of an ink jet printer comprising a receptacle (4) with a sealing element (7), in which the print cartridge (100) can be seated with close tolerance. The sealing element (7) is positioned against the ink nozzle (103) provided on the underside of the housing (101) and is brought into tight sealing engagement by means of a locking element (5) which engages with an edge of the casing of the print cartridge (100). In addition, a hollow needle carrier (18) with a hollow needle (17) is provided, which can be seated upon the print cartridge (100) or as the case may be, the receptacle (4). The hollow needle (17) penetrates through a bore hole (106) of the print cartridge (100) into the ink supply chamber on the inside of the print cartridge (100). A refill cartridge (200) can be stuck onto the hollow needle (17). With the help of this device, print cartridges can simply and safely be refilled. The refill process can run unattended, as soon as the refill cartridge (200) closure cap (210) is removed.

19 Claims, 13 Drawing Sheets

DEVICE, KIT, AND PROCESS FOR FILLING OF A PRINT CARTRIDGE OF AN INK JET PRINTER

BACKGROUND OF THE INVENTION

Field of the Invention

The invention is concerned with a device for refilling the print cartridge of an ink jet printer, a kit for refilling the print cartridge of an ink jet printer, and a process for refilling the print cartridge of an ink jet printer.

Description of the Related Art

Until the present, print cartridges for ink jet printers have as a rule been produced as expendable, one-way products. After depletion of the ink supply the print cartridge is simply thrown away and replaced by a new one. This is undesirable for ecological reasons since the used print cartridges are substantially completely functional and besides this include a number of valuable components, such as for example the ink nozzle, through which the ink is ejected, or the contact ribbon, which carries the electrical signals for controlling of the spraying of the ink, these parts having a life which substantially exceeds the span of time for a single use.

Proposals have already been made to fill this type of print cartridge by appropriate measures and thereby to extend the life span.

2For example, from WO 92/20577 there is known a refill container which is provided with a hollow needle. The hollow needle is inserted through an opening in the housing of the print cartridge and thereby enters into the ink supply chamber, which for example contains a sponge-like material. By pressing upon the elastic deformable form of the refill container the ink contained therein is filled into the ink supply space through the hollow needle.

Although this type of refill container is in principal adequate for the refilling of a print cartridge, in practice a number of problems occur. With this type of print cartridge, which substantially possesses only a single opening, through which the ink supply space can be had access to, it is as a rule not possible to prevent that the ink during the refilling process is ejected from the ink nozzle. This is the consequence of a building up of pressure which occurs after a short period of time as a result of the introduction of ink. The equalization of pressure with the ambient cannot be established rapidly enough through the hollow needle which is inserted into the opening and thus ink is ejected from the jet plate. It is thus necessary to place the print cartridge for the duration of a filling operation upon an absorptive substrate such as, for example, blotter paper, so that the ejected ink is collected. Further, it is necessary to carry out the filling process slowly and in certain cases with short breaks or pauses in order to make possible an adequate pressure equalization in order to reduce the leakage of ink to a minimum.

The refill process is thus not without problems, since the ink which runs out causes a danger of staining. It must therefore carefully be observed, that the necessary pressure equalization is permitted to occur. The refilling thus requires a careful attention to the necessary parameters, which is always possible in the common hectic of the office routine.

The servicing is made substantially more complicated in that print cartridges of new design are intended to be filled and refilled by means of an expensive fill and refill system.

This type of print cartridge contains in its inner space a flexible plastic sac, which during the printing process is in communication with air via an airhole. For a problem-free operation of the print cartridge, a second airhole is necessary. This type of print cartridge possesses thus a first ventilation opening in the area of the lid and a second ventilation opening in the vicinity of the oppositely lying provided print jet plate. Further, a refill opening is provided in the housing lid, which provides access to the ink supply chamber. The filling opening is closed by means of a ball during operation.

The refilling of this type of print cartridge is, for reasons of the sophisticated manner in which the refilling system was concocted, substantially more complicated and requires a strict adherence to a particular series of process steps. So first the vent openings in the area of the ink nozzle must be sealed. This occurs, for example, by the adhering over the opening of a foil patch. After that, the oppositely positioned vent holes provided on the container lid must be plugged, for example by means of a closing stopper. The ink jet must also be secured so that during the filling no ink is caused to be ejected therefrom. After that, the ball must be removed from the refill opening by pressing in. Only then, for example, by means of the above described refill container, can the ink supply be replenished. Even herewith it is necessary to observe that the refill process is conducted sufficiently slowly, and that the pressure equalization is permitted to occur.

After completion of the refill process, the fill opening must next be securely closed with a lock stopper. Thereafter, the vent opening located on the housing lid must be released and the securing patch must be pulled off of the oppositely lying, in the vicinity of the print plate, vent opening.

With this type of print cartridge, the securing of the two vent openings is immensely important. If this is neglected and filling is permitted to occur through the refill opening, then the ink will flow within a short period of time out of the container and the adjacent positioned refill opening.

SUMMARY OF THE INVENTION

The present invention has the objective to solve the problem of filling, and more particularly refilling, of a print cartridge of an inkjet printer to improve and to make more secure, so that mishaps are substantially avoided and the occurrence of spillage can be ruled out.

This problem is solved by means of a device for refilling a print cartridge, the print cartridge comprising a casing, an ink nozzle at a lower surface, a bore hole at an upper surface, and an ink chamber within said print cartridge, said device comprising a receptacle adapted to receiving said print cartridge with close sideways tolerance, said receptacle provided with a sealing element adapted to sealingly engage said ink nozzle of said print cartridge when said print cartridge is seated in said receptacle, a locking element for urging said ink nozzle of said print cartridge into sealing engagement against said sealing element of said receptacle, and a hollow needle carrier comprising a hollow needle and a carrier frame, said carrier frame adapted to be seatable upon the print cartridge after said print cartridge is seated in said receptacle, said hollow needle being positioned so that a first end of said needle penetrates through said bore hole into said ink chamber provided on the inside of said print cartridge when said hollow needle carrier is seated on said print cartridge, and the second end of said hollow needle projects upwardly.

The problem is moreover solved by means of a kit comprising the above device and an ink refill cartridge.

Finally, the problem is solved by means of the process for using the kit.

BRIEF DESCRIPTION OF THE DRAWING

The invention is now described by means of two illustrative embodiments. They are shown in schematic representation.

DETAILED DESCRIPTION OF THE INVENTION

Figure 1:
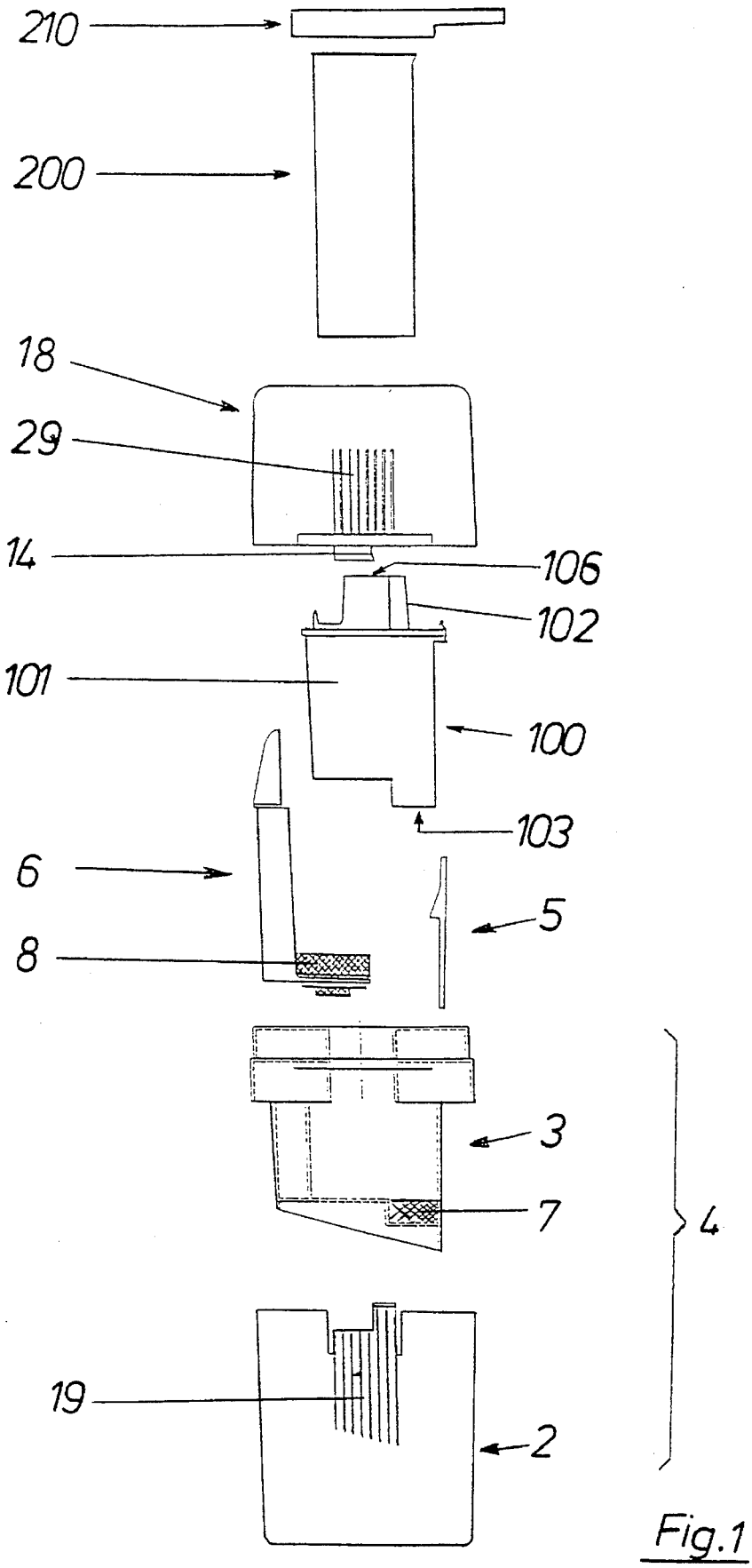
FIG. 1 Exploded diagram of the device in a first illustrative embodiment inclusive of refill cartridge, FIGS.2–6 Various process stages for the preparation of the refill process using the device according to FIG. 1, FIG. 7 Exploded diagram of the device in a second embodiment including refill cartridge, FIGS. 8–13 Various process steps for preparation of the refill process using the device according to FIG. 7.

The invention is based on the idea of providing a device into which the print cartridge to be filled can be introduced. By means of supplemental elements, which are tailored to the individual print cartridge, and which can be mounted on the print cartridge or, as the case may be, receptacle, the filling openings and the ink nozzle are securely sealed, while at the same time an entryway to the ink supply chamber is produced. For this, a receptacle with sealing elements is provided, in which the print cartridge, with close sideways tolerances and with a downwardly directed ink nozzle, can be inserted. The ink nozzle is directed against the sealing element and is brought into a leakproof arrangement by means of a locking element. A hollow needle carrier can be mounted upon the so installed print cartridge. The hollow needle carrier includes a hollow needle, which is insertable into a borehole provided in the lid area of the print cartridge and into the inside of the print cartridge and therewith in the ink supply chamber. This establishes a communicating connection to a refill cartridge, which can be seated at the top of the needle.

This basic version of the device is conceived for such print cartridges, which essentially comprise a single filling opening, for example, in the area of the lid. By the sealing of the ink nozzle, no ink can be extruded therefrom, and soiling of the substrate no longer occurs. Further, the introduction of ink is made particularly simple, since upon the sticking of the refill cartridge on to the hollow needle, the ink supply flows by itself, assisted by atmospheric pressure and capillary action, into the ink supply chamber. A further manual manipulation is not required. After the refill cartridge has been allowed to empty, the same need merely be pulled off of the hollow needle and the hollow needle carrier be removed from the print cartridge. The print cartridge is then ready for immediate use.

For print cartridges, which have additional openings, for example in the vicinity of the ink nozzle, there are contemplated additional embodiments of the invention. Since these print cartridges are, beyond this, characterized by having varying geometries, it is advantageous to be able to insert an adaptor into the receptacle, so that the device can be employed for a variety of varying print cartridges. In this case, the supplemental sealing elements can be introduced into the adaptor, so that it can be ensured that the correct arrangement of sealing elements and refill openings is attained.

The necessary pressure force between the sealing element and the print cartridge can be established in a simple way by means of a detente latch or pawl, which engages on one of the edges of the housing of the print cartridge.

For the type of print cartridge, which includes a vent opening in the area of the housing lid, a sealing element carrier is contemplated, which includes a sealing element and which can be set on top of the print cartridge. For attainment of the necessary pressure force the sealing element carrier may be provided with detente hooks, which are preferably inserted into the receptacle. The sealing element carrier and the hollow needle carrier are, in a preferred embodiment, so constructed in their geometric configuration with respect to each other that they can essentially only be assembled one upon the other in a pre-ordained sequence, and after refilling again can only be removed in the reverse sequence from one another. In this way it is, as described in detail above, necessary, first to close all ventilation openings, before the hollow needle can be introduced into the ink supply chamber. Likewise there must, following the refilling, the adherence to a predetermined sequence of steps be maintained. For this reason, the hollow needle carrier is so constructed, that it can only be seated upon the print cartridge, when prior to this the sealing element carrier has been seated. In the reverse, the sealing element carrier can only be removed, if the hollow needle carrier has already been removed.

In a concrete embodiment this has been solved thereby, that the sealing element carrier as well as the receptacle are provided with a special circumscribing rim profile, which serves as a receiving surface or, as the case may be, receiving surface for the hollow needle carrier. Respective offset step profiles make possible the assembly only in the prescribed manner.

The hollow needle carrier preferably includes a recess in the area of the hollow needle, which is designed to correspond to the refill cartridge to be seated thereupon, and which is adapted for guiding and receiving the lower portion thereof. This ensures the secure seating of refill cartridge upon the hollow needle carrier.

Further advantages can be obtained when the hollow needle carrier and the, as the case may be, sealing element carrier are constructed of transparent material. In this case the filling process can be observed as to whether ink is leaking out of the refill opening and, accordingly, whether the refilling process must be ended by removal of the refill cartridge. Although the volume of the refill cartridge is selected depending upon the receiving requirement of the ink supply chamber and therefore an overfilling is hardly possible, there can nevertheless be caused an unintentional emission of ink in the case that the print cartridge is refilled prior to the complete utilization of the ink supply.

The refilling of the print cartridge can further be optimized, when the device and the refill cartridge are adapted to one another, that is, in the form of a kit, and provided in this fashion. This is preferred when the refill cartridge is constructed with a cylindrical housing, which is closed off with a plug at one end, which plug can easily be dislodged by the hollow needle, so that the fluid connection between the cartridge and the ink supply chamber of the print cartridge is easily established. For the unattended emptying of the cartridge it is necessary to provide a vent possibility. This can be provided by a removable sealing element provided at the other end, for example in the form of a cork, a plug, a cap, a screw lid, a glued foil or a laminated foil.

It is particularly preferred when the hollow needle dislodgable plug is constructed of a self-sealing material. Thereby the refilling process can be interrupted at any time by pulling off the refilling cartridge from the hollow needle, and at a later time or with a different print cartridge can be resumed. Upon pulling off of the refill cartridge the plug reseals itself and prevents an unintentional release of ink.

With the help of the device according to the present invention inclusive of the corresponding refill cartridges most of the conventionally available print cartridges can by simple means and process, be refilled.

With the help of a first process, it is possible to accomplish a refilling of print cartridges of which the ink supply chamber is in communication with a vent opening bore hole in the lid from above. For this a device is employed, of which the main construction elements comprise a receptacle and a hollow needle carrier. First the print cartridge is inserted into the receptacle and the ink nozzle is sealed by the engagement of the housing with the locking element. Thereafter the needle carrier is installed upon the print cartridge. Thereby the print cartridge is ready for the refilling process. The refill cartridge is set upon the hollow needle carrier, whereby during the seating process the hollow needle stabs through the plug of the refill cartridge. Through releasing or removing of the sealing element the refill cartridge is vented and the ink flows by itself into the ink supply chamber. After the refill cartridge has run empty, or as the case may be, upon attainment of the desired refill condition, the refill cartridge is pulled up off of the hollow needle so that after removal of the hollow needle carrier the refilled print cartridge can, without further steps, be removed.

With a second process, the type of print cartridges can be refilled, which are provided with ventilation systems as described in the above introductory portion. For this a device is employed which, besides the main construction element receptacle and hollow needle carrier, additionally includes a sealing element carrier.

First the print cartridge is inserted and the detention or locking element is secured. As a result thereof not only the ink nozzle, but also the ventilation opening provided adjacent to the ink nozzle is sealed. Next the ventilation opening which is to be found up above in the housing lid is closed off by the seating thereon of a sealing element carrier on the print cartridge. In addition, by an engagement of the locking mechanism, the print cartridge is with increased pressure urged against the sealing element associated with the ventilation opening provided adjacent to the ink nozzle. Finally the hollow needle carrier is seated upon the sealing element carrier, whereby the hollow needle enters into the ink supply chamber. In this way the printer is readied for the refill process.

The refill cartridge is seated upon the hollow needle carrier, whereby the hollow needle stabs into the plug. Thereafter, the sealing element is released or removed, so that the ink can flow into the ink supply chamber by itself. After completion of the refill process the refill cartridge is removed from the hollow needle and the hollow needle carrier is removed. Now the refill bore hole is to be closed with a closing plug. Only thereafter is the sealing element carrier to be lifted off and the refilled print cartridge to be removed.

In the following the first embodiment of the device is described, which serves for the refilling of a print cartridge 100.

According to FIG. 1, print cartridge 100 includes a casing 101, which on the bottom surface is provided with a ink nozzle 100. The opposite side the casing 101 is provided with a lid 102, which is provided with a bore hole 106. The bore hole 106 serves on the one hand as a ventilation bore hole, and on the other hand as a refill bore hole for the ink supply chamber which is to be found internal of the casing 101, and which is not shown. The ink supply chamber is largely comprised of a very fluid receptive filler material. This can be a material similar to a sponge or of the type corresponding to a foam.

The device according to the invention is comprised of two main construction elements, namely a receptacle 4 and a hollow needle carrier 18. The receptacle 4 is comprised of a receptacle insert 3, a housing 2 provided with a grip area 19 adapted to be grasped by the fingers of a user, as well as a detente latch 5. The receptacle insert 3 includes a sealing element 7, which serves to close off the ink nozzle 103. Further, an adapter 6 is provided in the present case for adapting to the geometry of the print cartridge 100, which adapter is additionally provided with a sealing element 8. In the present case the sealing element 8 is without a sealing function, since the print cartridge 100 is not provided with a ventilation opening at its bottom side. The sealing element 8 nevertheless follows the contour of the housing underside of the print cartridge 100 and can serve as a supplemental support.

The hollow needle carrier 18 includes detente hooks 14, which are adapted to engage in a recess in the receptacle insert 3, and a grip area 29 adapted to be grasped by the fingers of a user.

The ink supply is provided by a refill cartridge 200, which is sealed at its upper end by a closing cap 210.

Figure 2:
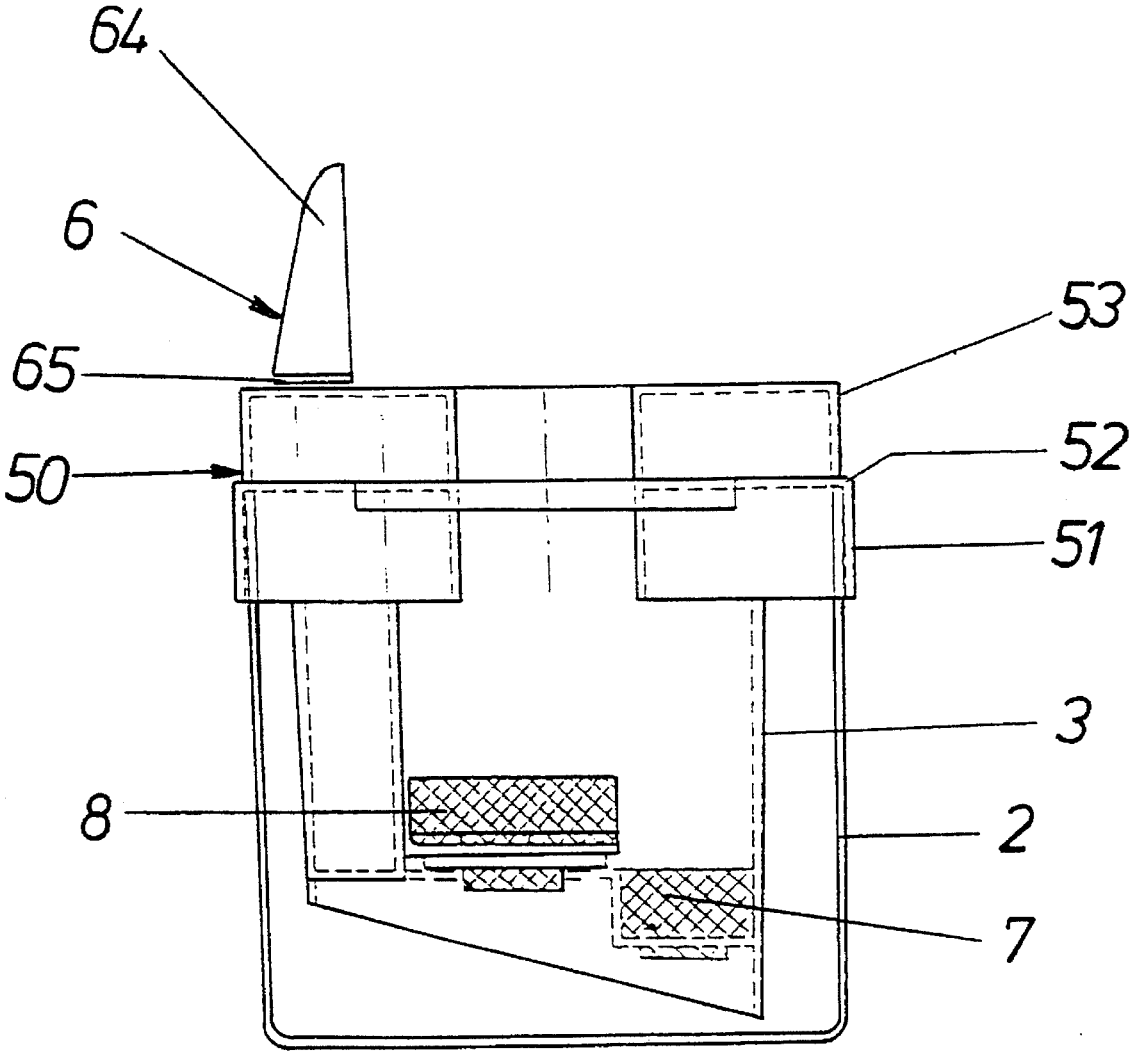

In FIG. 2, the beginning condition is schematically represented. The receptacle insert 3 is inserted into the housing 2. For this the receptacle insert 3 displays at its upper end a cuff-like rim profile 50, whereby an outwardly directed profile section 51 overlaps with the housing 2 in its upper area and circumscribingly encompasses. The profile section 51 transitions step-wise towards above into a rim step 53. The herewith formed step 52 serves as a receiving surface for the hollow needle carrier 18, which makes overlapping contact with the rim step 53.

The sealing element 7 is provided in the receptacle insert 3.

In the receptacle insert 3, the adapter 6 is loosely inserted. It is comprised essentially of an L-shaped cross-section. In the upper area of the adapter 6 a receiving edge or rim 65 is formed, which comes to rest on the receptacle insert 3. Further, there is provided in this area an upright standing rib 64, which serves as a grip surface for handling of the adapter 6.

Figure 3:
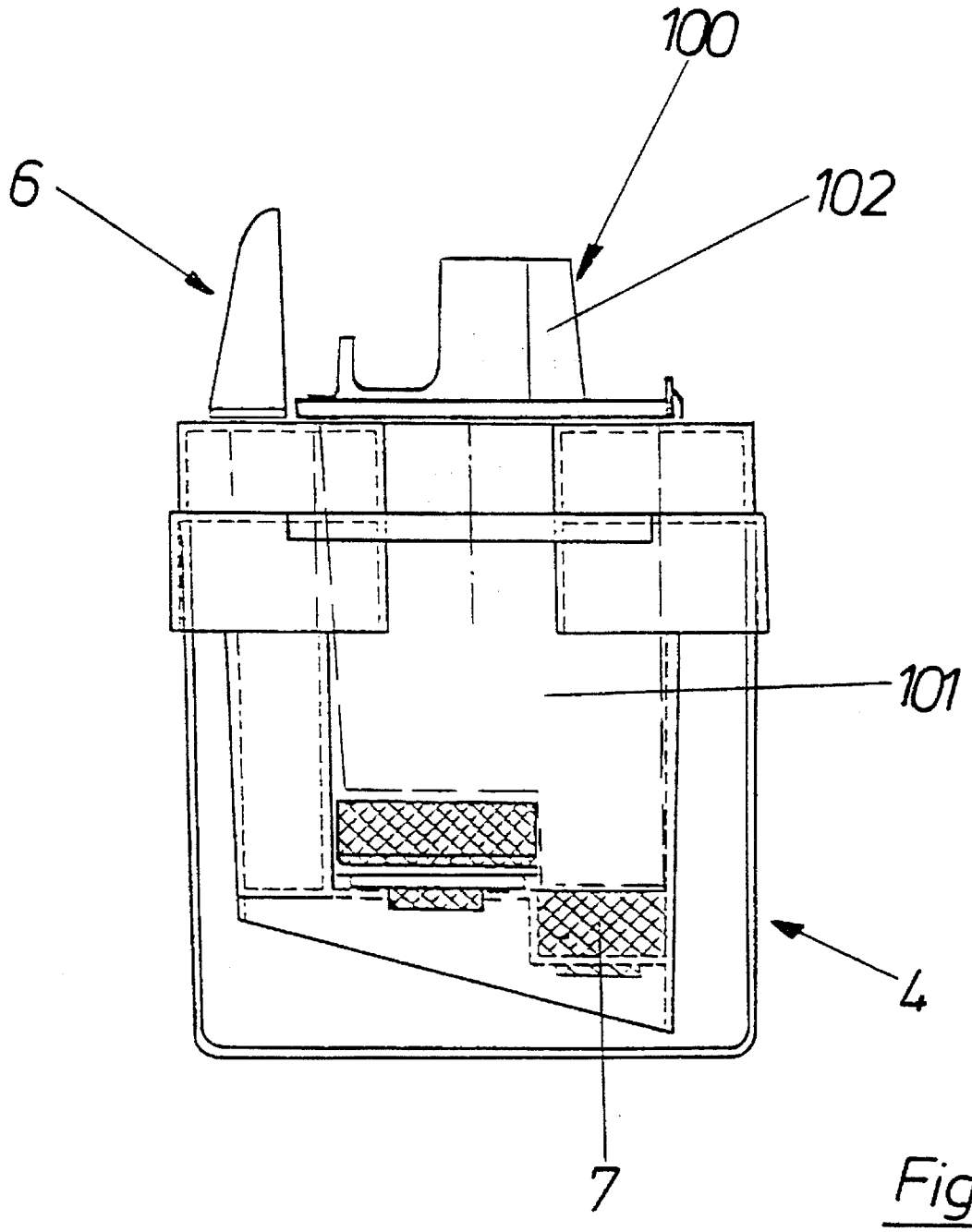

In the representation according to FIG. 3, the print cartridge 100 is inserted in the receptacle 4. The casing 101 is thereby completely taken up by the receptacle 4, whereby the adapter 6 is held on the inside thereof via the installed print cartridge 100. The lid 102 of the print cartridge 100 protrudes above the receptacle 4.

Not shown here is the detente latch 5, which on the rim of the casing 101 is installed under tension and thereby ensures that the ink nozzle 103 is held securely pressed against the sealing element 7.

Figure 4:
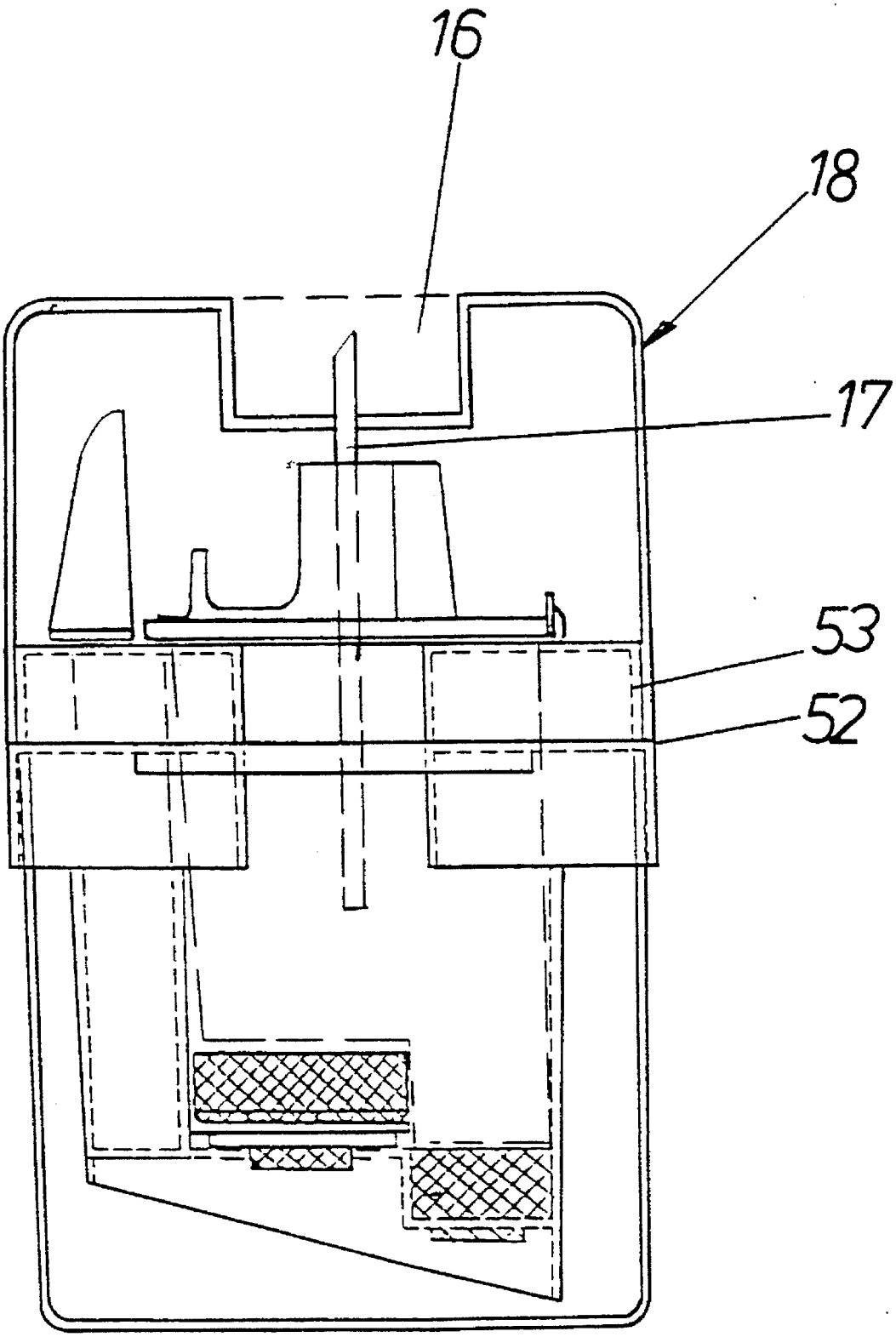

In FIG. 4, the hollow needle carrier 18 is installed. In its bottom end it rests upon the recess 52 of the rim profile 50 of the receptacle insert 3. Further, it has overlapping contact with the rim step 53 of the rim profile 50. Hereby the hollow needle carrier 18 is held fast by means of frictional contact. Further, there may be provided in a not shown means and way engagingly fixed detente hooks on the receptacle 4, for example in the area of the rim profile 50.

On the hollow needle carrier 18, a hollow needle 17 is attached. The position of the hollow needle 17 is selected so that the needle corresponds with the bore 106 in the lid 102 and penetrates through this in the shown manner. The length of the hollow needle 17 is measured in the downward direction so that it penetrates at least halfway into the ink supply chamber. Thereby it is ensured, that the lower lying levels of the ink receiving room are sufficiently quickly filled with ink.

Towards the upwards direction the hollow needle 17 penetrates the hollow needle carrier 18 in the vicinity of the recess 16. The tip of the hollow needle 17 ends however, still within the recess 16, so that no acute danger of injury by the tip of the hollow needle 17 exists. The recess 16 is circular-cylindrically shaped, in order to encompass the cylindrically shaped casing 201 of the refill cartridge 200 in its lower region.

Figure 5:
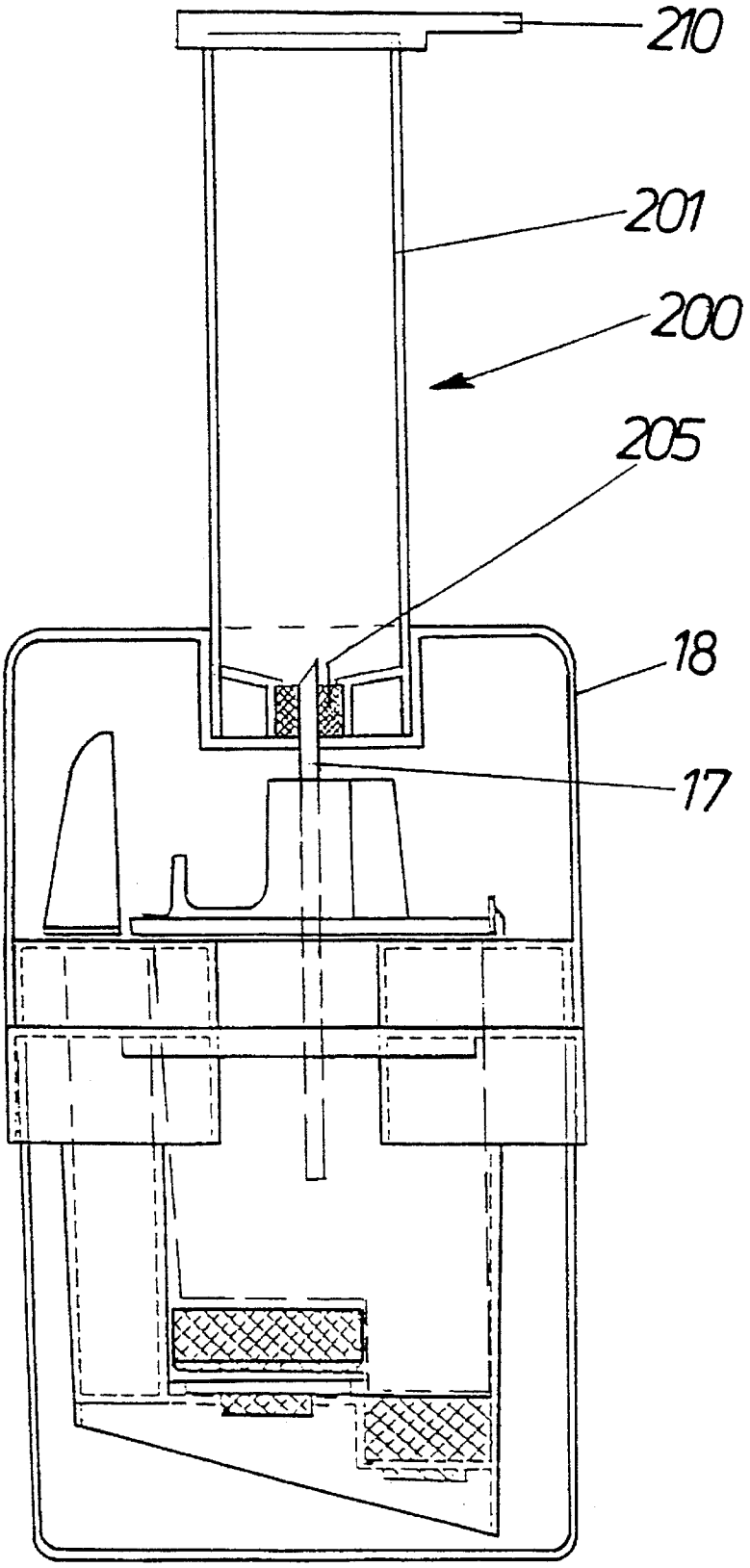

In FIG. 5 the refill cartridge 200 is seated upon the hollow needle carrier 18. The hollow needle 17 has penetrated through the plug 205 and a connection has been established between the ink supply room and the inside of the refill cartridge 200. The refill cartridge 200 is in the represented situation still closed with cap 210.

Figure 6:
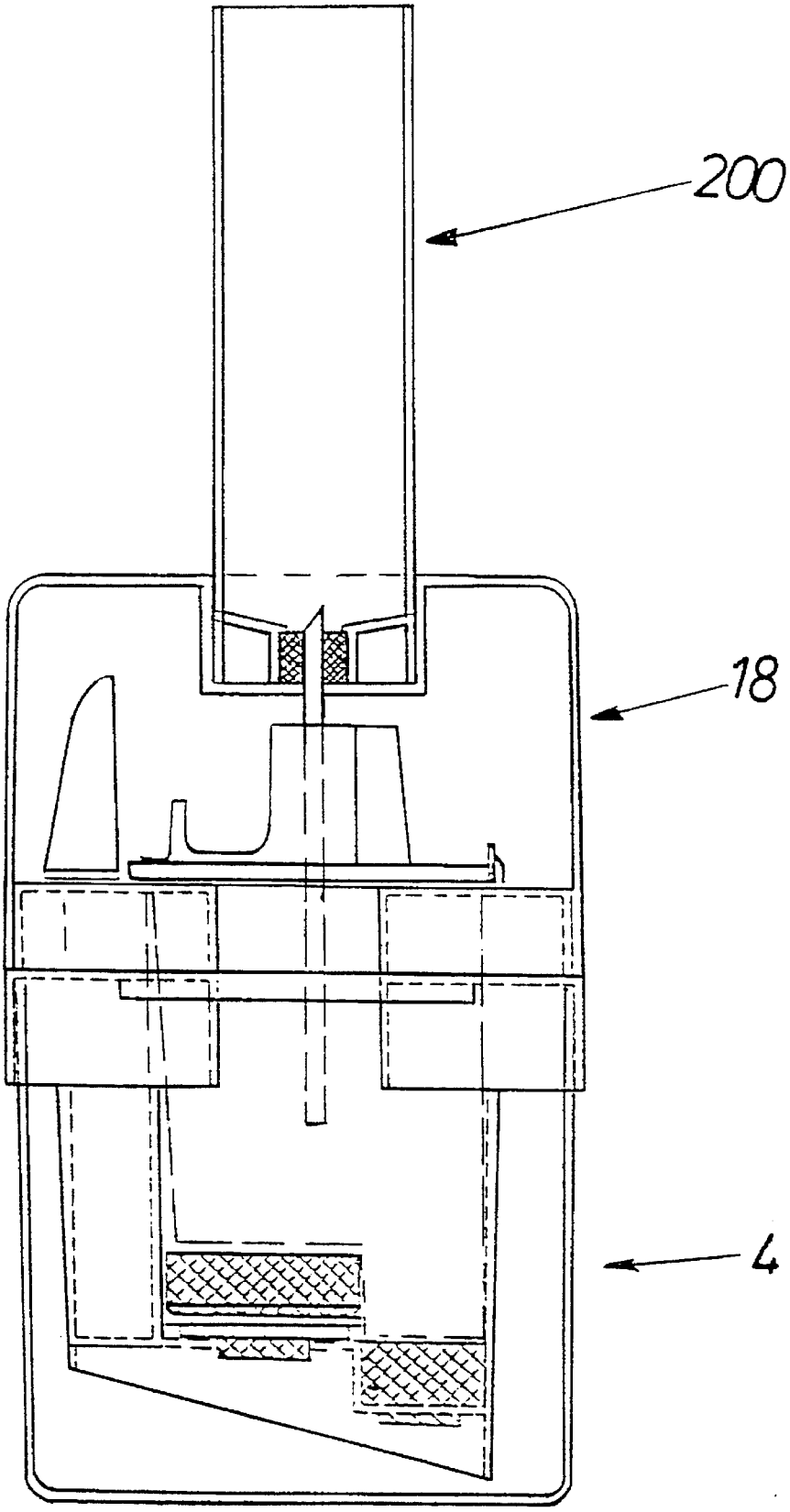

In the representation according to FIG. 6, the cap 210 is removed. The inside of the refill cartridge 200 is thereby vented and the refill process can run by itself.

Figure 7:
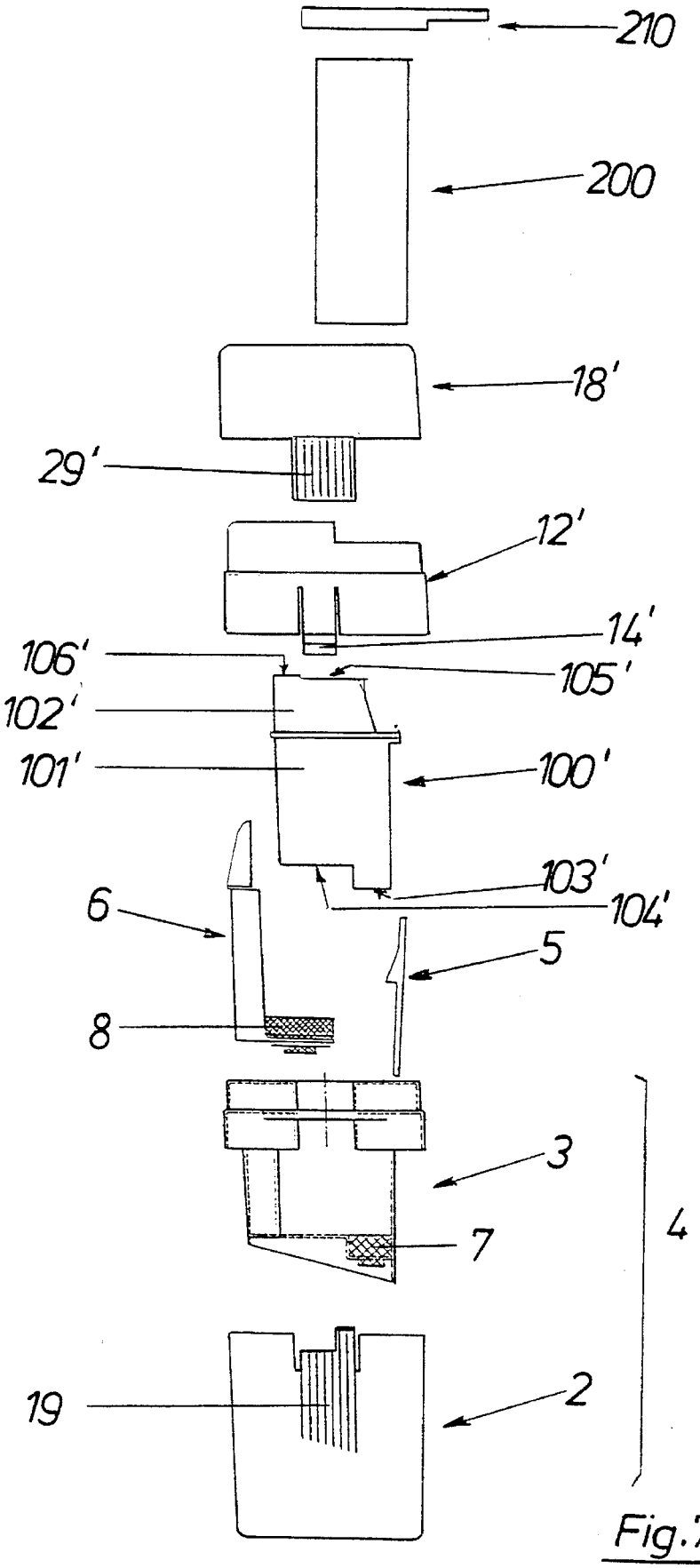

In FIG. 7 a device is shown for filling of a print cartridge 100'. This comprises a casing 101', on the underside of which a ink nozzle 100' as well as a ventilation plate opening 104' is provided. The casing 101' is closed from the upper side by means of a lid 102', which adjacent to a further ventilation opening 105' is provided with a bore hole 106'. The bore hole 106' is on the operating side securely closed with a not shown ball.

The construction of the receptacle 4 is in agreement with the concept of the device of the first embodiment. In distinction therewith the sealing element 8 which is provided on adapter 6 has the task to close off the ventilation opening 104' on the underside of the casing 101' of the print cartridge 100'.

The essential difference between the device according to the first embodiment is comprised thereof that additionally a further main construction element, namely the sealing element carrier 12' is provided. This has the function which is discussed in the following of sealing the ventilation opening 105' which is found in the lid 102'. The sealing element carrier 12' is fixably seatable upon the receptacle insert 3 and by means by detente hooks 14'. The hollow needle carrier 18', provided with a grip area 29', is seatable on the sealing element carrier 12'.

Figure 8:
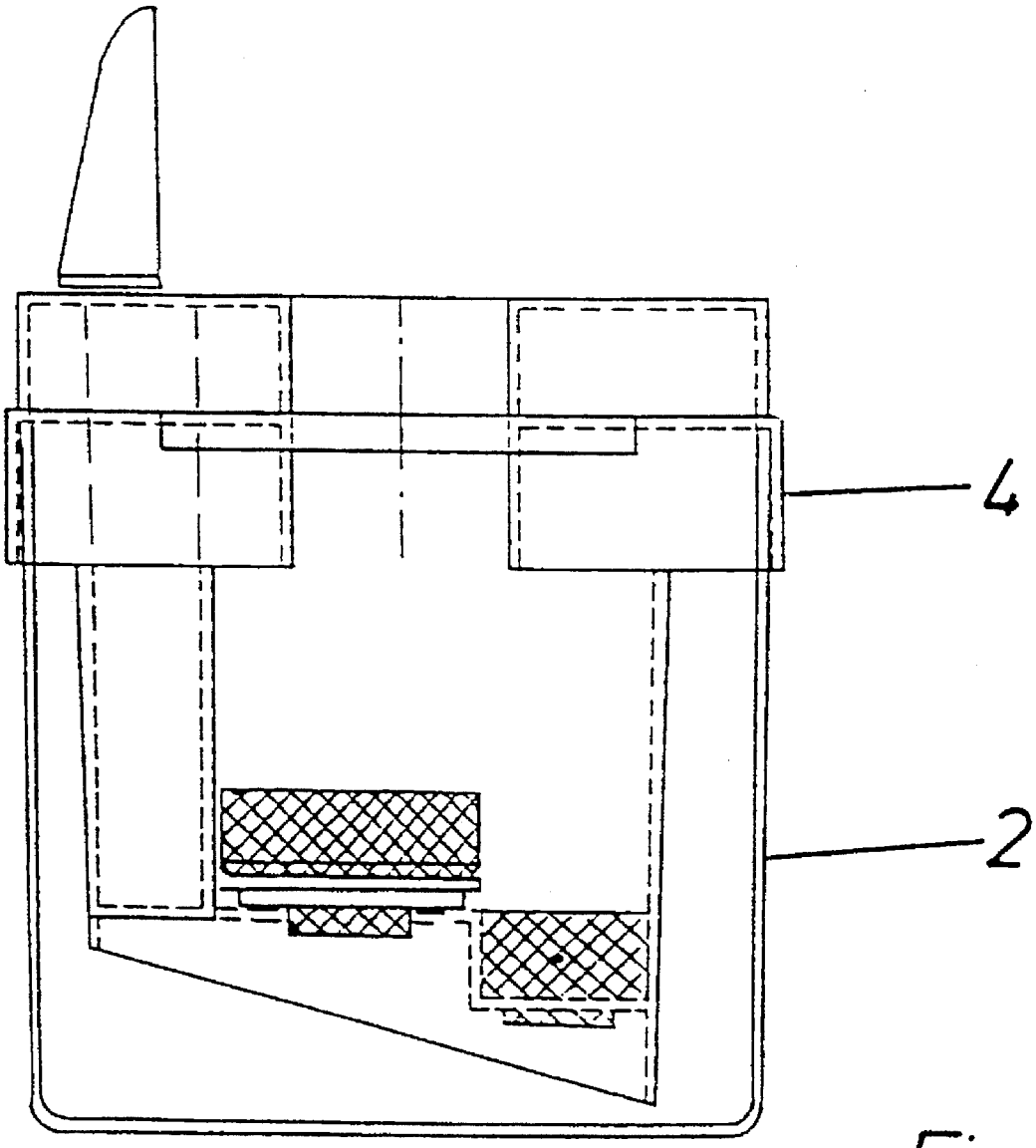

The starting arrangement as shown in FIG. 8 is in correspondence with that of FIG. 2.

Figure 9:
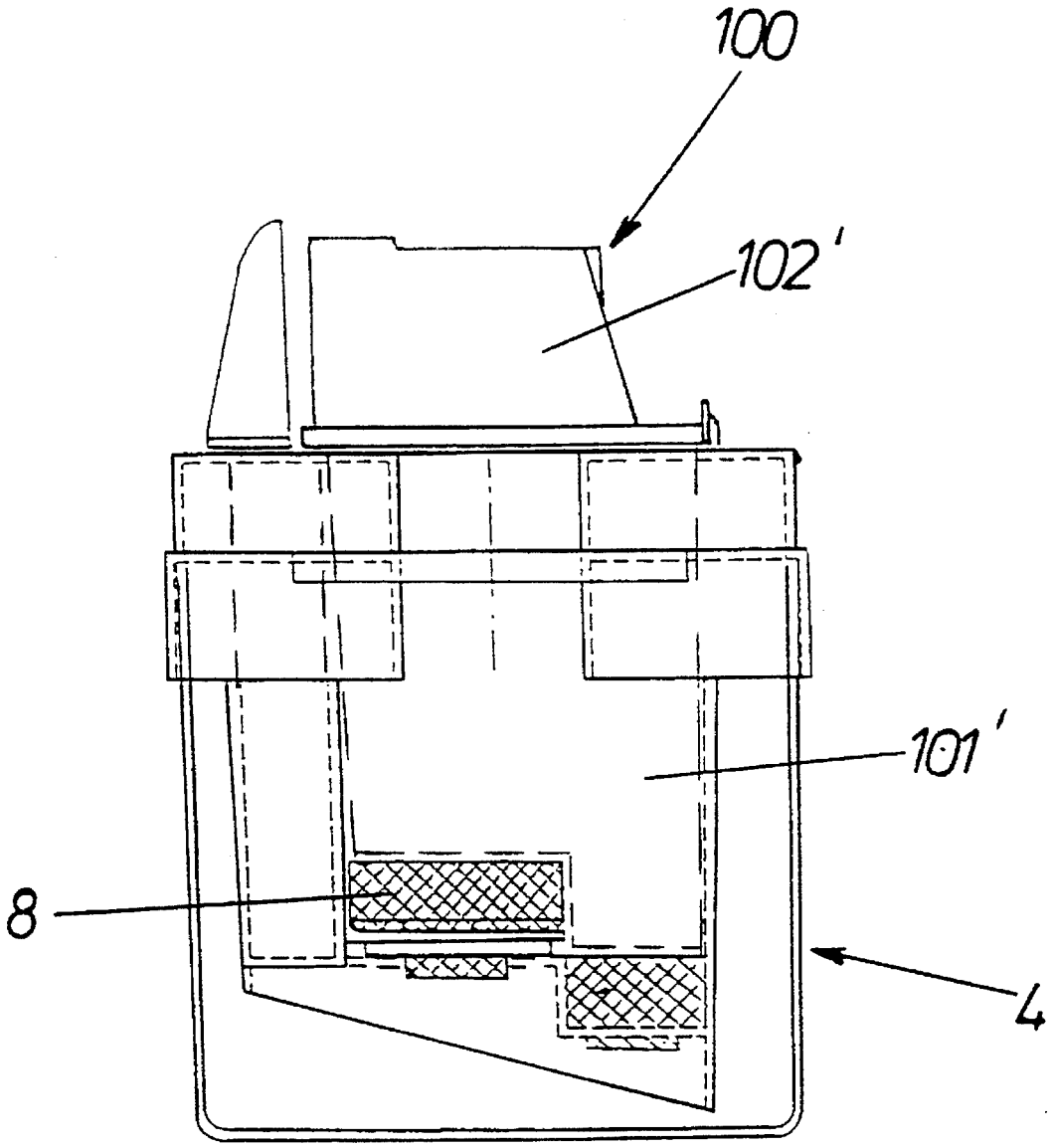

This is true also for the position according to FIG. 9, which is in correspondence with the position according to FIG. 3. Functionally, however, there is the difference that the sealing element 8 is pressed and retained against the underside of the casing 101', to close off the there to be found ventilation opening 104'.

Figure 10:
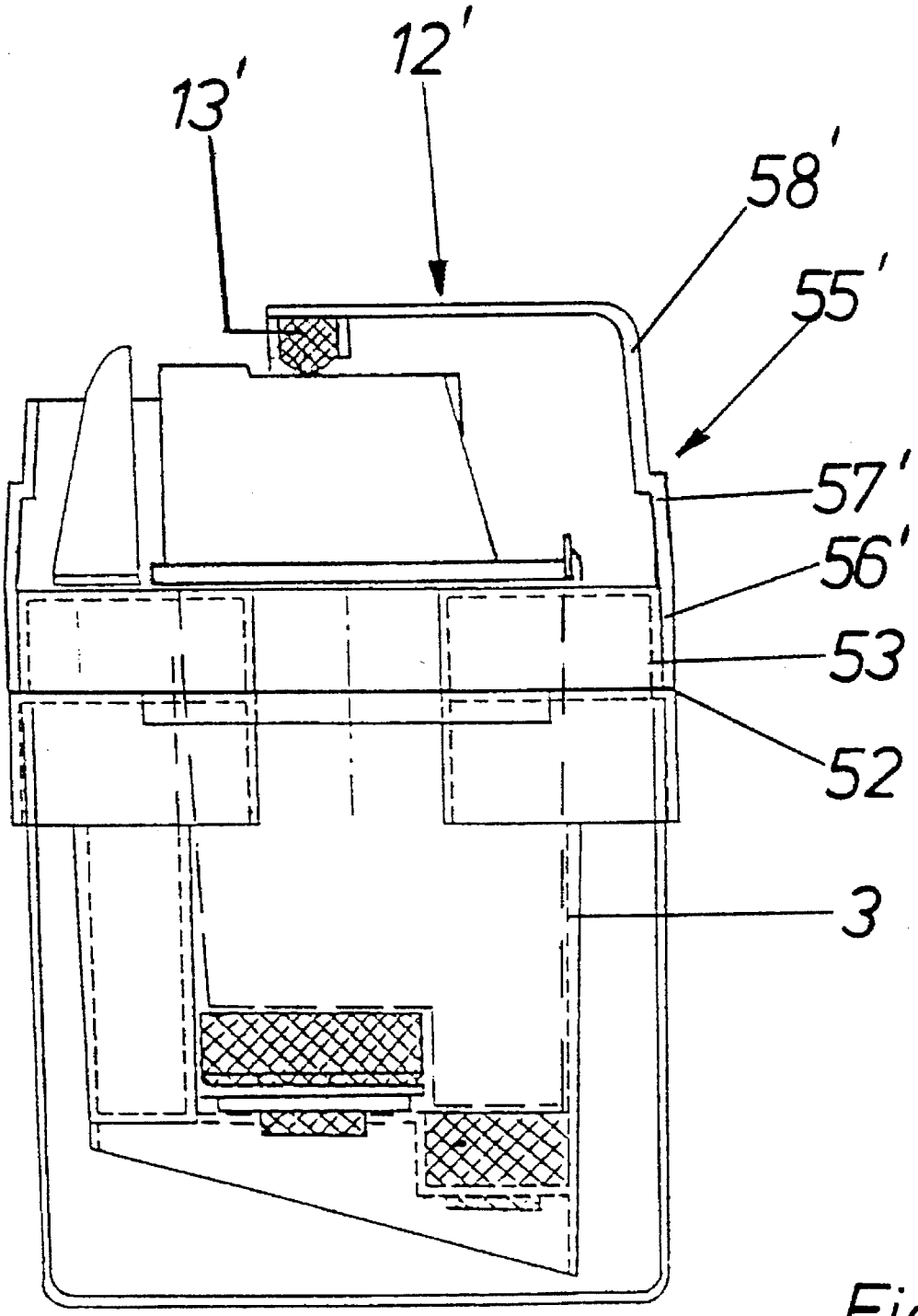

FIG. 10 shows the configuration with the seated sealing element carrier 12'. The sealing element carrier 12' has the task, to hold the sealing element 13' against the ventilation opening 105' which is found in the lid 102', and to hold it presses and thereby to seal. The sealing element carrier 12' possesses on its bottom end a rim profile 55' with an underneath profile section 56'. The profile section 56' rests upon the rim step 52 of the receptacle insert 3. On its inner side the rim profile 56' has contact with the rim step 53 of the receptacle insert 3. A profile section 56' transitions into the form of a recess 57' in a further profile section 58'.

Figure 11:
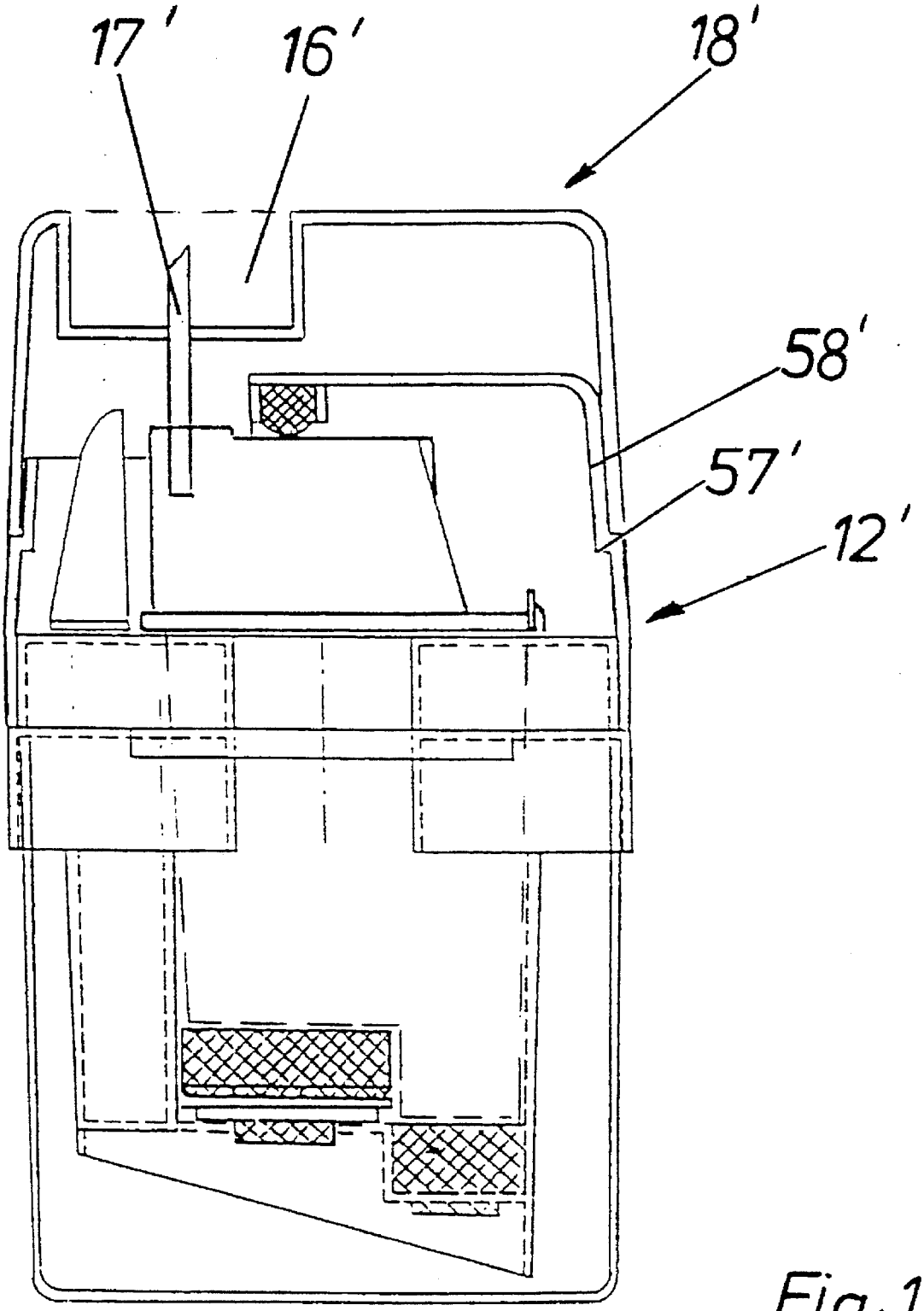

FIG. 11 shows the device with needle carrier 18' seated, which rests upon the recess 57 of the sealing element carrier 12'. The hollow needle carrier 18' has, besides this, contact with the profile section 58' and is held by means of frictional contact. Further, here not shown securing elements can be used to supplementally secure hollow needle carrier 18'.

The hollow needle carrier 18' is provided with a recess 16', which corresponds to the shape of the refill cartridge 200. In the area of the recess 16' there is to be found the hollow needle 17', the position of which is determined to correspond to the bore hole 106' of the print cartridge 100. The hollow needle 17' penetrates essentially a short distance into the ink supply chamber, since this is not filled with a fluid absorptive material as in the case of the print cartridge 100, rather which is constructed as a hollow chamber and contains a plastic sac as described in the introductory section.

Figure 12:
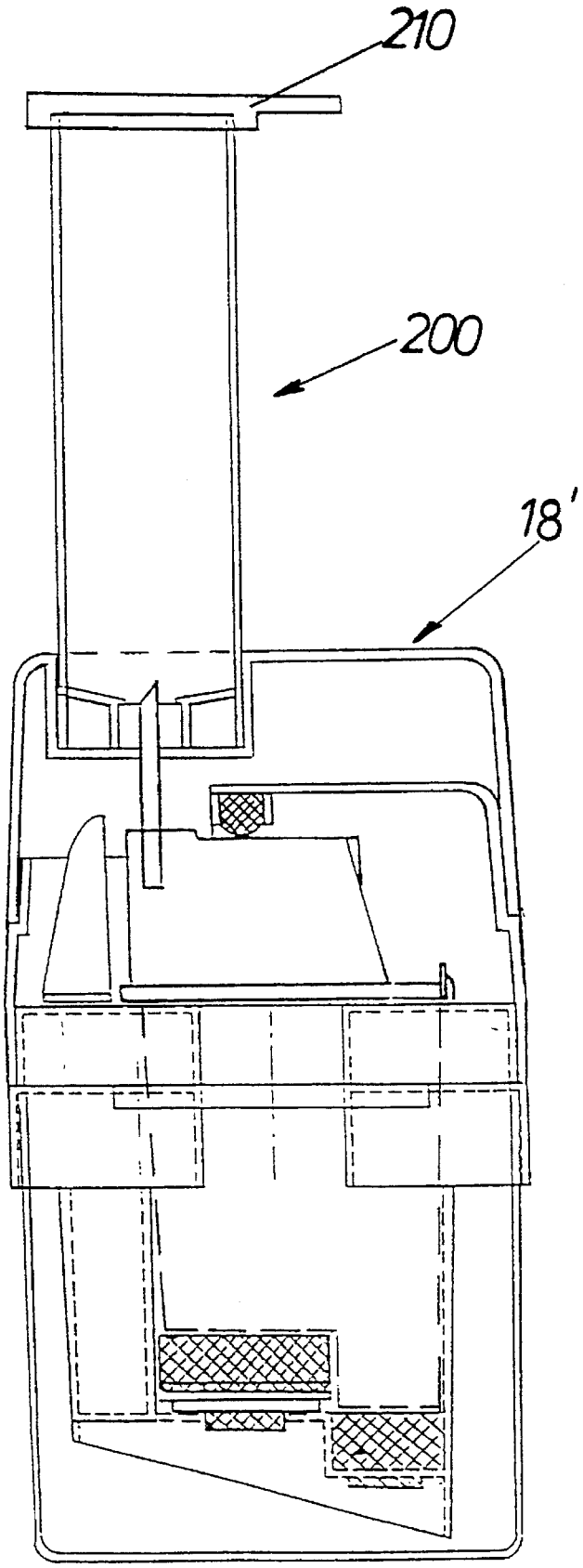

FIG. 12 shows finally the refill cartridge 200 seated upon the hollow needle carrier 18', which is still closed with the cap 210.

Figure 13:
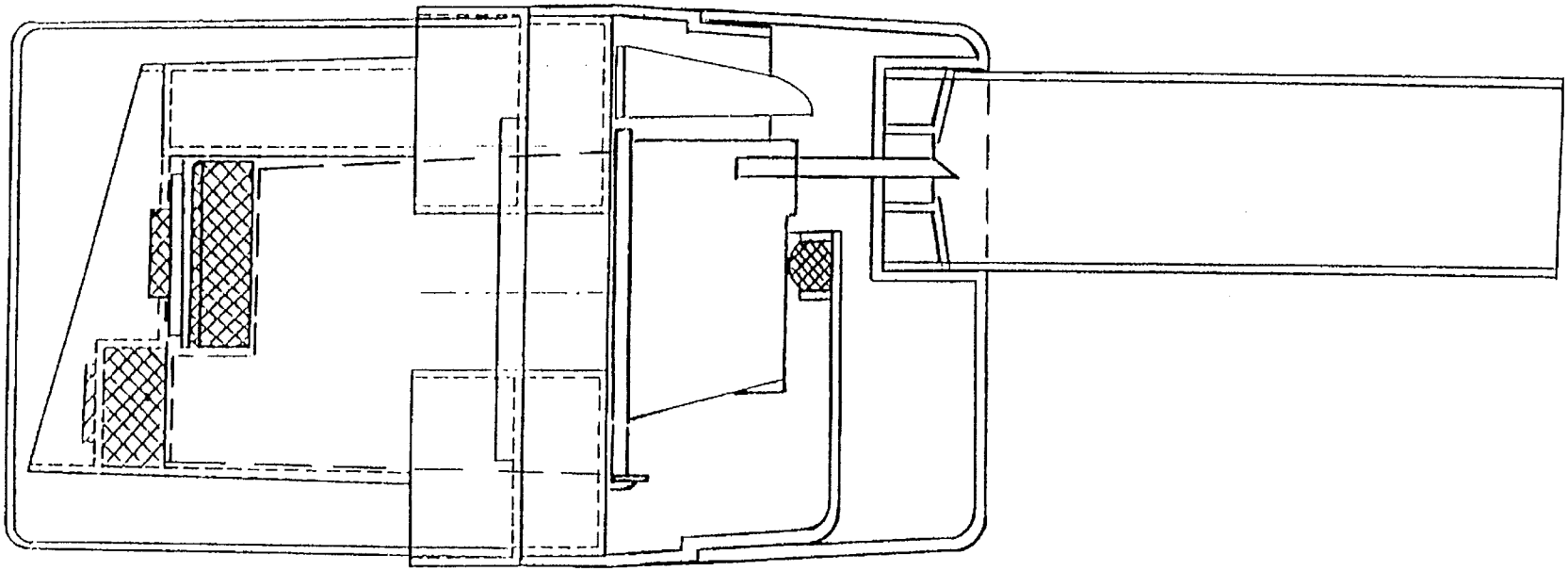

In FIG. 13 the cap 210 is removed, and the refill process can now run by itself.

According the described principle, a variety of print cartridges as conventionally available can simply and securely be refilled. As a result of the modular construction of the device it is possible to give a large measure of flexibility. Depending upon the assembly of the main construction elements, devices or, as the case may be, kits, may be assembled which are either directed to a certain type of print cartridge or are suitable universally for various print cartridge types. And the last case it is essentially necessary, for example, supplementally to the device with the hollow needle carrier 18, to provide a further hollow needle carrier 18' and a seal carrier 12'.

What is claimed is:

1. A device for refilling a print cartridge (100, 100'), said print cartridge comprising a casing, an ink nozzle at a lower surface, a bore hole at an upper surface, and an ink chamber within said print cartridge, said device comprising:

a receptacle (4) adapted to receiving said print cartridge (100, 100') with close sideways tolerance, said receptacle provided with a sealing element (7) adapted to sealingly engage said ink nozzle of said print cartridge when said print cartridge is seated in said receptacle;

a locking element (5) for urging said ink nozzle of said print cartridge into sealing engagement against said sealing element of said receptacle; and a hollow needle carrier (18, 18') comprising a hollow needle (17, 17') and a carrier frame, said carrier frame adapted to be seatable upon the print cartridge (100, 100') after said print cartridge is seated in said receptacle (4), said hollow needle being positioned so that a first end of said needle penetrates through said bore hole (106, 106') into said ink chamber provided on the inside of said print cartridge (100, 100') when said hollow needle carrier is seated on said print cartridge, and the second end of said hollow needle projects upwardly.

2. A device according to claim 1, wherein said receptacle (4) is provided with at least a second sealing element (8)

adapted for the sealing engagement of a ventilation opening (104, 104') provided on said print cartridge adjacent to the ink nozzle (103, 103').

3. A device according to claim 1, wherein receptacle (104) is constructed for receiving adapters (6) for adapting receptacle (104) to receiving a variety of print cartridges (100, 100') of varying dimensions.

4. A device according to claim 3, wherein at least one sealing element is provided on the adaptor (6).

5. A device according to claim 1, wherein said locking element (5) is in the form of a detente latch, which is adapted for engagement with a rim of the casing of the print cartridge (100, 100') to be seated and thereby to urge the print cartridge (100, 100') with pressure against said sealing element and to so hold it under pressure.

6. A device according to claim 1, further comprising a sealing element carrier (12') adapted to being seated upon said receptacle (4) containing a print cartridge (100'), said sealing element carrier (12') including a sealing element (13') adapted for sealing a ventilation opening (105') in the upper area of said print cartridge.

7. A device according claim 6, wherein the sealing element carrier (12') is constructed of transparent material.

8. A device according to claim 6, wherein sealing element carrier (12') includes engaging elements (14') in the form of detente hooks, which are adapted to engage in the receptacle (4) and thereby to hold the sealing element (13) under tension against the ventilation opening (104') and to hold the print cartridge (100') in its entirety against the ink nozzle sealing element with increased tension.

9. A device according to claim 6, wherein receptacle (4), the sealing element carrier (12'), and the hollow needle carrier (8') are geometrically constructed with respect to each other so that the hollow needle carrier (8') can be seated on receptacle (4) only after sealing element carrier (12') is seated on receptacle (4).

10. A device according to claim 9, wherein receptacle (4) is comprised of a housing (2) and a receptacle insert (3), said receptacle insert (3) provided on its upper end with a cuff-like rim profile (50) with an outwardly spaced profile section (51) which encompassingly overlaps with the upper rim of housing (2), said profile section (51) is further provided with a circumscribing recess (52), the inner surface of which is adapted for serving as a receptacle for the upper edge of the housing (2) and the outer surface of which is adapted for serving as the receptacle for the sealing element carrier (12').

11. A device according to claim 10, wherein sealing element carrier (12') on its lower end exhibits a step-shaped rim profile (55') with a profile section (56'), which overlappingly encompasses the receptacle insert (3) in the upper region and further the rim profile (55') possesses a circumscribing recess (57'), the outer surface of which serving as a receptacle for said hollow needle carrier (18').

12. A device according to claim 1, wherein the hollow needle carrier (18, 18') is provided with a recess (16, 16') in the area of the hollow needle (17, 17'), said recess adapted for matingly receiving a refill cartridge (200).

13. A device according claim 1, wherein the hollow needle carrier (18, 18') is constructed of transparent material.

14. A kit for refilling a print cartridge (100, 100') of an ink jet printer, said print cartridge comprising a casing, an ink nozzle at a lower surface, a bore hole at an upper surface, and an ink chamber within said print cartridge, said kit comprising:

a receptacle (4) adapted to receiving said print cartridge (100, 100') with close sideways tolerance, said receptacle provided with a sealing element (7) adapted to sealingly engage said ink nozzle of said print cartridge when said print cartridge is seated in said receptacle, a locking element (5) for urging said ink nozzle of said print cartridge into sealing engagement against said sealing element of said receptacle, a hollow needle carrier (18, 18') comprising a hollow needle (17, 17') and a carrier frame, said carrier frame adapted to be seatable upon the print cartridge (100, 100') after said print cartridge is seated in said receptacle (4), said hollow needle being positioned so that a first end of said needle penetrates through said bore hole (106,106') into said ink chamber provided on the inside of said print cartridge (100, 100') when said hollow needle carrier is seated on said print cartridge, and the second end of said hollow needle projects upwardly, and a refill cartridge (210).

15. A kit according to claim 14, wherein the refill cartridge (210) is comprised of a cylindrical housing (201), which at one end is closed with a plug (205) adapted to be stuck through by the hollow needle (17, 17') and at the other end is sealed with a removable sealing element (210).

16. A kit according to claim 15, wherein plug (205) is comprised of a self-sealing material.

17. A kit according to claim 15, wherein the sealing element (210) is one chosen from a list comprising; a cork, a plug, a cap, a screw lid, a glued foil and a laminated foil.

18. A process for filling a print cartridge (100) with the use of a kit, said print cartridge comprising a casing, an ink nozzle at a lower surface, a bore hole at an upper surface, and an ink chamber within said print cartridge, said kit comprising:

a receptacle (4) adapted to receiving said print cartridge (100, 100') with close sideways tolerance, said receptacle provided with a sealing element (7) adapted to sealingly engage said ink nozzle of said print cartridge when said print cartridge is seated in said receptacle, a locking element (5) for urging said ink nozzle of said print cartridge into sealing engagement against said sealing element of said receptacle, a hollow needle carrier (18, 18') comprising a hollow needle (17, 17') and a carrier frame, said carrier frame adapted to be seatable upon the print cartridge (100, 100') after said print cartridge is seated in said receptacle (4), said hollow needle being positioned so that a first end of said needle penetrates through said bore hole (106, 106') into said ink chamber provided on the inside of said print cartridge (100, 100') when said hollow needle carrier is seated on said print cartridge, and the second end of said hollow needle projects upwardly, and a refill cartridge (210); and said process comprising:

(a) introducing the print cartridge (100) in the receptacle (4), (b) securing the ink nozzle against a sealing element (103) by locking of the locking element (5), (c) introducing a hollow needle (17) into the inside of the ink supply chamber in the inside of the print cartridge (100) by seating a hollow needle carrier (18) on the print cartridge (100), (d) seating a refill cartridge (200) on the hollow needle carrier (18), (e) removing or releasing a closure element (210), (f) removal of the refill cartridge (200) from the hollow needle (17) after at least some of the ink has been transferred from the refill cartridge (200) to the print cartridge, (g) removing the hollow needle carrier (18), (h) removing the refilled print cartridge (100).

19. A process for refilling a print cartridge (100') with the use of a kit, said print cartridge comprising a casing, an ink nozzle at a lower surface, a bore hole at an upper surface, a ventilation opening (104') adjacent to the ink nozzle, a ventilation opening (105') adjacent to said bore hole, and an ink chamber within said print cartridge, said kit comprising:

a receptacle (4) adapted to receiving said print cartridge (100, 100') with close sideways tolerance, said receptacle provided with a sealing element (7) adapted to sealingly engage said ink nozzle of said print cartridge when said print cartridge is seated in said receptacle, a locking element (5) for urging said ink nozzle of said print cartridge into sealing engagement against said sealing element of said receptacle, a hollow needle carrier (18, 18') comprising a hollow needle (17, 17') and a carrier frame, said carrier frame adapted to be seatable upon the print cartridge (100, 100') after said print cartridge is seated in said receptacle (4), said hollow needle being positioned so that a first end of said needle penetrates through said bore hole (106, 106') into said ink chamber provided on the inside of said print cartridge (100, 100') when said hollow needle carrier is seated on said print cartridge, and the second end of said hollow needle projects upwardly, and a refill cartridge (210); and said process comprising:

(a) introducing the print cartridge (100') in the receptacle (4), (b) sealing the ink nozzle (103') and the ventilation opening (104') by locking of the locking element (5), (c) closing the ventilation opening (105') by seating of a sealing element carrier (12') on the print cartridge (100') and increasing the pressure force of the print cartridge (100') on the sealing elements (7,8) by locking of the locking hooks (14), (d) introducing the hollow needle (17') in the ink supply chamber located inside of the print cartridge (100') by seating of the hollow needle carrier (18') of the sealing element carrier (12,), (e) seating of the refill cartridge (200) on the hollow needle carrier (18'), (f) releasing or removing of the closure element (210), (g) removing the refill cartridge (200) from the hollow needle (17') after at least some of the ink has been transferred from the refill cartridge (200) to the print cartridge, (h) removing the hollow needle carrier (18'), (i) sealing the bore hole (106') with a stopper plug, (j) removing the sealing element carrier (12'), (k) removing of the refilled print cartridge (100').

* * * * *